United States Patent [19]

Westermann et al.

[11] Patent Number: 4,915,865

[45] Date of Patent: Apr. 10, 1990

[54] DIMENSIONALLY STABLE ALKALINE CLEANSING AGENTS OF LOW DENSITY, AND A PROCESS FOR THEIR PREPARATION

[75] Inventors: Lothar Westermann, Cologne; Hannsjörg Ulrich; Werner Klose, both of Erftstadt, Fed. Rep. of Germany

[73] Assignee: Hoechst Aktiengesellschaft, Frankfurt am Main, Fed. Rep. of Germany

[21] Appl. No.: 207,454

[22] Filed: Jun. 16, 1988

[30] Foreign Application Priority Data

Jun. 30, 1987 [DE] Fed. Rep. of Germany ..... 3721461

[51] Int. Cl.[4] ..... C11D 7/06; C11D 7/12

[52] U.S. Cl. ..... 252/157; 252/135; 252/156; 252/174; 252/174.14; 252/174.16; 252/DIG. 17

[58] Field of Search ..... 252/135, 156, 174, 174.14, 252/174.16, DIG. 16, DIG. 17, 186.35, 187.33, 157

[56] References Cited

U.S. PATENT DOCUMENTS

| | | | |
|---|---|---|---|
| 3,391,083 | 7/1968 | Irani et al. | 252/99 |
| 4,070,298 | 1/1978 | Scardera et al. | 252/89 |
| 4,141,938 | 2/1979 | Klose | 260/928 |
| 4,493,782 | 1/1985 | Williamson | 252/95 |
| 4,690,770 | 9/1987 | Jeschke et al. | 252/99 |

FOREIGN PATENT DOCUMENTS

| | | |
|---|---|---|
| 0203526 | 12/1986 | European Pat. Off. . |
| 3519353 | 12/1986 | Fed. Rep. of Germany . |
| 1379377 | 1/1975 | United Kingdom . |

*Primary Examiner*—Paul Lieberman
*Assistant Examiner*—John F. McNally

[57] ABSTRACT

Dimensionally stable alkaline cleansing agents of low density consist at least of 2 to 50% by weight of alkali metal phosphates, 2 to 50% by weight of silicates and 1 to 60% by weight of alkali metal hydroxides and/or alkali metal carbonates or bicarbonates and additionally contain 0.25 to 10% by weight of phosphoric acid partial esters.

These cleansing agents are prepared by first foaming phosphoric acid partial esters with water in a weight ratio of (1:2) to (1:80), using intensive stirring. When the remaining components have been incorporated into the foam, using stirring or kneading, the resulting mixture is converted to moldings. The moldings are allowed to set for 0.5 to 15 hours.

13 Claims, No Drawings

DIMENSIONALLY STABLE ALKALINE CLEANSING AGENTS OF LOW DENSITY, AND A PROCESS FOR THEIR PREPARATION

The present invention relates to dimensionally stable alkaline cleansing agents of low density, which consist at least of 2 to 50% by weight of alkali metal phosphates, 2 to 50% by weight of silicates and 1 to 60% by weight of alkali metal hydroxides and/or alkali metal carbonates or bicarbonates, and to a process for their preparation.

Since pulverulent cleansing agents are frequently products which dust severely, and which furthermore, because of their content of hygroscopic constituents, for example alkali metal hydroxides of alkali metasilicates, tend to cake or form lumps, it has already been proposed to employ, on the metering devices of milking machines and commercial dishwashers, cleansing agents in the form of fused blocks which have been obtained by casting a homogeneous composition in molds. In this process, alkali metal silicate, alkali metal hydroxide, alkali metal triphosphate and a compound which releases active chlorine are stirred with water to give a pourable homogeneous composition (compare European Patent Application No. 203,526); the pourable composition can also be free from alkali metal hydroxides (compare U.S. Pat. No. 4,690,770); alternatively, alkali metal silicate, alkali metal hydroxide, alkali metal triphosphate and an organic complexing agent are conjointly fused at about 60° C. (compare DE-OS No. 3,519,353).

It is a disadvantage of the known cleansing agents in the form of fused blocks that because of their sparing solubility and because of the different amounts dissolved off them, they can only be used with special metering systems. In the case of direct metering, for example in dishwashers, a fused block dissolves only incompletely within the time available, and this necessarily results in diminished cleaning action.

It is accordingly the object of the present invention to provide a dimensionally stable cleansing agent which consists at least of alkali metal phosphates, silicates, alkali metal hydroxides and/or alkali metal carbonates or bicarbonates, and a process for its preparation, with the cleansing agent having a low density and disintegrating easily on contact with water. According to the invention this is achieved if the cleansing agent additionally contains 0.25 to 10% by weight of a partial ester of phosphoric acid. The dimensionally stable cleansing agent according to the invention can optionally also be further developed by (a) using phosphoric acid monoesters, phosphoric acid diesters or their mixtures as phosphoric acid partial esters;
(b) obtaining the phosphoric acid partial esters by reaction of phosphorylating agents with organic hydroxy compounds;
(c) using polyphosphoric acids as phosphorylating agents;
(d) using diphosphorus pentoxide as the phosphorylating agent.

A process for the preparation of the cleansing agent according to the invention can be characterized in that the phosphoric acid partial ester is foamed with water in the weight ratio of (1:2) to (1:80), preferably of (1:3.5) to (1:72), using intensive stirring, that the remaining components are incorporated into the foam, using stirring and/or kneading, that the resulting mixture is converted to moldings and that the moldings are allowed to set for 0.5 to 15 hours.

Furthermore, the said process can optionally also be performed in such a way that (e) the moldings are obtained by filling the mixture into molds;
(f) the moldings are obtained by extruding the mixture;
(g) the extruded strands are cut into pieces.

As phosphorylating agents for the preparation of the phosphoric acid partial esters used according to the invention there may be employed polyphosphoric acids of various degrees of condensation; examples of suitable organic hydroxy compounds are oligoglycol ethers of alcohols with 6 to 15 carbon atoms per molecule or of corresponding industrial mixtures of alcohols or of (alkyl-)-phenols with 6 to 15 carbon atoms per molecule, in each case with 2 to 12 ethylene oxide units and/or propylene oxide units per molecule of the alkyl oligoglycol ether or (alkyl-)aryl oligoglycol ether. As organic hydroxyl components for the reaction with the phosphorylating agents there may furthermore be employed mixtures of monohydric organic hydroxy compounds of the type described above with polyhydric organic hydroxy compounds, for example in accordance with the procedure of German Pat. No. 2,645,211.

The cleansing agent according to the invention may for example contain, as alkali metal phosphates, monosodium dihydrogen monophosphate, disodium hydrogen monophosphate, trisodium monophosphate, monopotassium dihydrogen monophosphate, dipotassium hydrogen monophosphate, tripotassium monophosphate, disodium dihydrogen diphosphate, trisodium hydrogen diphosphate, tetrasodium diphosphate, tetrapotassium diphosphate, pentasodium triphosphate, pentapotassium triphosphate or high molecular weight water-soluble polyphosphates such as Graham's salt.

As silicates, the cleansing agent according to the invention may contain sodium metasilicate, waterglass solutions with a ratio of $Na_2O:SiO_2=1:2.0$ to 1:3.5, flaky silicates or zeolite A.

The cleansing agent according to the invention may contain sodium hydroxide and/or potassium hydroxide (anhydrous or as the monohydrate) as well as sodium carbonate or potassium carbonate.

The cleansing agent according to the invention may further contain complexing agents such as phosphonates and/or sodium salts of ethylenediaminetetraacetic acid or of nitrilotriacetic acid and/or complexing carboxylic acids such as citric acid or tartaric acid in amounts of 0.5 to 5% by weight.

Further, the cleansing agent according to the invention may contain surfactants, for example fatty alcohol polyglycol ethers with 12 to 18 carbon atoms and 3 to 25 mols of ethylene oxide, ethylenediamine/ethylene oxide/propylene oxide adducts, fatty alcohol/ethylene oxide/propylene oxide adducts or block polymers of propylene oxide and ethylene oxide.

Finally, the cleansing agent according to the invention may contain 0.1 to 10% by weight of compounds which release active oxygen or active chlorine, such as perborates, persulfates, chlorinated isocyanuric acids or "Chloramin T" (sodium N-chloro-p-toluenesulfonamide).

In the preparation of the cleansing agents according to the invention, a doubling of volume is achieved by foaming the phosphoric acid partial ester. The volume increase can be further augmented by admixture of agents which release gas.

It is surprising that the cleansing agents according to the invention, even with only a very small addition of a phosphoric acid partial ester and without further auxiliaries for stabilizing the foam or for thickening or dispersing the solids or for use as setting accelerators, constitute stable cleansing agent moldings which on introduction into water disintegrate easily. When these cleansing agent moldings are introduced into water, they disintegrate directly into a coarsely granular mixture which dissolves in the same way as a pulverulent product.

Further, it is surprising that compounds which release active chlorine can be introduced into the cleansing agents according to the invention with virtually no loss of active chlorine, though as a rule substances possessing surfactant properties, such as phosphoric acid partial esters, or the water required for the foaming process, cause rapid disintegration of, for example, dichloroisocyanurates.

EXAMPLE 1

0.5 part by weight of phosphoric acid partial ester, 26.5 parts by weight of water and 8.5 parts by weight of sodium bicarbonate were mixed homogeneously by stirring with a dissolver disk, and converted to a stable foam. 30.7 parts by weight of anhydrous sodium metasilicate, 7.7 parts by weight of hydrated pentasodium triphosphate and 26.1 parts by weight of non-hydrated pentasodium triphosphate (having a 40% phase I content) were introduced into the foam by means of a kneader, and the mixture was homogenized, with the temperature of the composition present in the kneader being kept below 60° C. The moldable composition taken from the kneader hardened after about 24 hours at room temperature; if the composition is allowed to age at 60° to 80° C., its hardening is speeded up.

The density of the foamed composition immediately after its preparation was 0.78 kg/l.

If, in the formulation, the phosphoric acid partial ester is replaced by the same quantity of water, the resulting composition has a density of 1.71 kg/l immediately after its preparation.

EXAMPLE 2

0.25 part by weight of phosphoric acid partial ester, 18 parts by weight of water and 17 parts by weight of 50 percent strength by weight sodium hydroxide solution were mixed and foamed at 36° C., with stirring. 30.7 parts by weight of anhydrous sodium metasilicate, 7.7 parts by weight of hydrated pentasodium triphosphate, 23.1 parts by weight of non-hydrated pentasodium triphosphate and 3 parts by weight of "Chloramin T" were introduced into the foam, and the mixture was homogenized.

The density of the foamed composition immediately after its preparation was 0.93 kg/l. After 6 weeks' aging of the cleansing agent moldings at room temperature, an active chlorine degradation of 11% was found.

If, in the formulation, the phosphoric acid partial ester is replaced by the same quantity of water, the resulting composition has a density of 1.49 kg/l immediately after its preparation.

EXAMPLE 3

A cleansing agent of

- 2.5 parts by weight of phosphoric acid partial ester
- 28.0 parts by weight of water
- 31.5 parts by weight of anhydrous sodium metasilicate
- 10.0 parts by weight of hydrated pentasodium triphosphate and
- 28.0 parts by weight of non-hydrated pentasodium triphosphate was prepared, analogously to Example 1, at 56° C.

The density of the foamed composition immediately after its preparation was 0.62 kg/l; after 20 hours' aging at 75° C. in a drying cabinet it was 0.525 kg/l.

If, in the formulation, the phosphoric acid partial ester is replaced by the same quantity of water, the composition after 20 hours' aging at 75° C. has a density of 1.8 kg/l.

EXAMPLE 4

A cleansing agent of

- 0.5 parts by weight of phosphoric acid partial ester
- 25.0 parts by weight of water
- 14.0 parts by weight of anhydrous sodium metasilicate
- 30.0 parts by weight of non-hydrated pentasodium triphosphate with about 40% phase I
- 20.0 parts by weight of hydrated pentasodium triphosphate
- 0.5 part by weight of sodium ethylenediaminetetraacetate and
- 10.0 parts by weight of sodium perborate tetrahydrate was prepared, analogously to Example 1, at 56° C.

The density of the foamed composition, after 20 hours' drying at room temperature, was 0.67 kg/l.

If, in the formulation, the phosphoric acid partial ester is replaced by the same quantity of water, the composition after 20 hours' drying at room temperature has a density of 1.4 kg/l.

EXAMPLE 5

A cleansing agent of

- 5.0 parts by weight of phosphoric acid partial ester
- 17.5 parts by weight of water
- 5.0 parts by weight of anhydrous sodium disilicate
- 50.0 parts by weight of pentasodium triphosphate
- 12.5 parts by weight of sodium nitrilotriacetate as a 40% strength aqueous solution and
- 10.0 parts by weight of "Chloramin T".

was prepared, analogously to Example 1, at 56° C.

The density of the cleansing agent moldings according to the invention, after aging (24 hours at room temperature), was 1.17 kg/l.

If, in the formulation, the phosphoric acid partial ester is replaced by the same quantity of water, moldings having a density of 1.46 kg/l are obtained after 24 hours' aging at room temperature.

EXAMPLE 6

A cleansing agent of

- 1 part by weight of phosphoric acid partial ester
- 10 parts by weight of water
- 30 parts by weight of sodium hydroxide
- 50 parts by weight of sodium metasilicate pentahydrate
- 5 parts by weight of Graham's salt and
- 4 parts by weight of phosphonic acid (50% strength solution)

was prepared, analogously to Example 1, at 56° C.

The density of the resulting cleansing agent was 1.4 kg/l.

If, in the formulation, the phosphoric acid partial ester is replaced by the same quantity of water, the agent has a density of 1.74 kg/l.

EXAMPLE 7

A cleansing agent of
0.5 part by weight of phosphoric acid partial ester
4.5 parts by weight of water
20.0 parts by weight of sodium hypochlorite solution
30.0 parts by weight of sodium hydroxide
24.0 parts by weight of flaky silicate and
26.0 parts by weight of pentasodium triphosphate
was prepared, analogously to Example 1, at 58° C.

The density of the cleansing agent moldings after 3 weeks' aging at room temperature was 1.48 kg/l.

If, in the formulation, the phosphoric acid partial ester is replaced by the same quantity of water, the moldings have a density of 1.92 kg/l after 3 weeks' storage at room temperature.

EXAMPLE 8

A cleansing agent of
1 part by weight of phosphoric acid partial ester
20 parts by weight of water
30 parts by weight of sodium hydroxide
40 parts by weight of lamellar silicate
5 parts by weight of sodium sulfate and
4 parts by weight of phosphonic acid
was prepared, analogously to Example 1, at 57° C.

The density of the cleansing agent moldings after two weeks' storage at room temperature was 1.36 kg/l.

If, in the formulation, the phosphoric acid partial ester is replaced by the same quantity of water, the moldings have a density of 1.86 kg/l after two weeks' storage.

All the cleansing agents according to the invention, which were prepared in accordance with Examples 1 to 8, disintegrated 0.5 to 2 minutes after having been introduced into water and dissolved speedily, depending on the temperature of the water.

We claim:

1. A process for the preparation of a dimensionally stable alkaline cleansing agent of low density, said agent comprising
2 to 50% by weight of alkali metal phosphate,
2 to 50% by weight of a silicate and
1 to 60% by weight of alkali metal hydroxide,
alkali metal carbonate or bicarbonate or mixtures thereof,
which process comprises foaming 0.25 to 10% by weight, on the same weight basis as the listed ingredients a phosphoric acid partial ester, selected from the group consisting of phosphoric acid monoester, phosphoric acid diester or mixtures thereof having been obtained by reaction of a phosphorylating agent with an organic hydroxy compound, with water in a weight ratio of (1:2) to (1:80), using intensive stirring, incorporating into the foam further components selected from alkali metal phosphate, a silicate, alkali metal hydroxide, alkali metal carbonate and alkali metal bicarbonate, using stirring and kneading, respectively, converting the resulting mixture to moldings and allowing the moldings to set for 0.5 to 15 hours.

2. The process according to claim 1, wherein a phosphoric acid partial ester is foamed with water in the weight ratio of (1:3.5) to 1:72.

3. The process according to claim 1, wherein the moldings are obtained by filling the mixture into molds.

4. The process according to claim 1, wherein the moldings are obtained by extruding the mixture.

5. The process according to claim 4, wherein the extruded strands are cut into pieces.

6. The process as claimed in claim 1, wherein the phosphorylating agent is a polyphosphoric acid.

7. The process as claimed in claim 1, wherein the phosphorylating agent is diphosphorus pentoxide.

8. A dimensionally stable alkaline cleansing agent of low density, which comprises:
2 to 50% by weight of alkali metal phosphate
2 to 50% by weight of a silicate
1 to 60% by weight of alkali metal hydroxide,
alkali metal carbonate or bicarbonate, or mixtures thereof, and
0.25 to 10% by weight of a phosphoric acid partial ester selected from the group consisting of phosphoric acid monoester, phosphoric acid diester or mixtures thereof having been obtained by reaction of a polyphosphoric acid with an organic hydroxy compound, said cleansing agent disintegrating 0.5 to 2 minutes after having been introduced into water and dissolving speedily therein.

9. A dimensionally stable alkaline cleansing agent of low density, which comprises:
2 to 50% by weight of alkali metal phosphate
2 to 50% by weight of a silicate
1 to 60% by weight of alkali metal hydroxide,
alkali metal carbonate or bicarbonate, or mixtures thereof, and
0.25 to 10% by weight of a phosphoric acid partial ester selected from the group consisting of phosphoric acid monoester, phosphoric acid diester or mixtures thereof having been obtained by reaction of diphosphorus pentoxide with an organic hydroxy compound, said cleansing agent disintegrating 0.5 to 2 minutes after having been introduced into water and dissolving speedily therein.

10. A foamed, molded solid alkaline cleansing agent which is dimensionally stable in the dry state, comprising:
0.25 to 10% by weight of phosphoric acid partial ester which is a phosphoric acid monoester, phosphoric acid diester or mixture thereof, said phosphoric acid partial ester being combined and stirred with sufficient water to form a foam, and, incorporated into said foam,
2 to 50% by weight of alkali metal phosphate,
2 to 50% by weight of a silicate,
1 to 60% by weight of alkali metal hydroxide, alkali metal carbonate, alkali metal bicarbonate, or mixture thereof, said foam having been molded and permitted to set to form a foamed molded solid cleansing agent which is dimensionally stable in the dry state but disintegrates 0.5 to 2 minutes after having been introduced into water and dissolves in said water, the density of said foamed molded solid being lower as compared to an unfoamed molded solid with the same ingredients except for substitution of water for the phosphoric acid partial ester.

11. The cleansing agent according to claim 10, wherein the phosphoric acid partial ester is obtained by reaction of a phosphorylating agent with an organic hydroxy compound.

12. The cleansing agent according to claim 11, wherein the phosphorylating agent is phosphoric acid or diphosphorus pentoxide.

13. The cleansing agent according to claim 10, wherein the phosphoric acid partial ester has been foamed by stirring it with water in a weight ratio of 1:2 to 1:80.

* * * * *